US008887710B2

(12) United States Patent
Rossi et al.

(10) Patent No.: US 8,887,710 B2
(45) Date of Patent: Nov. 18, 2014

(54) COOKING GAS BURNER

(75) Inventors: Carlo Rossi, Adelaide (AU); Marco Rossi, Adelaide (AU)

(73) Assignee: Aktiebolaget Electrolux, Stockholm (SE)

( * ) Notice: Subject to any disclaimer, the term of this patent is extended or adjusted under 35 U.S.C. 154(b) by 1467 days.

(21) Appl. No.: 11/577,874

(22) PCT Filed: Oct. 27, 2005

(86) PCT No.: PCT/SE2005/001620

§ 371 (c)(1),
(2), (4) Date: Feb. 7, 2008

(87) PCT Pub. No.: WO2006/046922

PCT Pub. Date: May 4, 2006

(65) Prior Publication Data

US 2008/0210216 A1 Sep. 4, 2008

(30) Foreign Application Priority Data

Oct. 28, 2004 (AU) ..... 2004906239

(51) Int. Cl.

| | |
|---|---|
| ***F24C 3/00*** | (2006.01) |
| ***F24C 3/08*** | (2006.01) |
| ***F24C 15/08*** | (2006.01) |
| ***F23Q 3/00*** | (2006.01) |
| ***F23Q 9/00*** | (2006.01) |
| ***F23D 14/58*** | (2006.01) |
| ***F23D 14/62*** | (2006.01) |
| ***F23D 14/06*** | (2006.01) |

(52) U.S. Cl.

CPC ..... *F24C 3/085* (2013.01); *F23D 2900/14062* (2013.01); *F23D 14/065* (2013.01)

USPC ..... 126/39 E; 126/1 R; 126/39 A; 126/39 B; 126/39 C; 126/39 R; 431/264; 431/265; 431/266; 431/278; 431/283; 431/354; 431/285; 431/286

(58) Field of Classification Search

CPC ..... F23D 14/04; F23D 14/06; F23D 14/66; F23D 2900/14062; F24C 3/082; F24C 3/085

USPC ..... 126/1 R, 39 R, 39 A, 39 B, 39 C, 39 E; 431/354, 263, 264, 265, 266, 278, 283, 431/285, 286; D7/407

See application file for complete search history.

(56) References Cited

U.S. PATENT DOCUMENTS

| | | | | |
|---|---|---|---|---|
| 2,497,787 | A * | 2/1950 | Minster | 126/39 N |
| 3,324,925 | A * | 6/1967 | McLaren | 239/434 |

(Continued)

FOREIGN PATENT DOCUMENTS

| | | |
|---|---|---|
| CN | 2658584 A | 11/2004 |
| EP | 0 634 608 | 7/1994 |

(Continued)

OTHER PUBLICATIONS

EP 1406043 Machine Translation from Espacenet; Bernard Dane, Vincent Fabienne, Patrick Hunault, and Christope Trochou; Apr. 7, 2004; Description Pages.*

(Continued)

*Primary Examiner* — Kenneth Rinehart
*Assistant Examiner* — William Corboy
(74) *Attorney, Agent, or Firm* — Pearne & Gordon LLP

(57) ABSTRACT

The present invention provides a cooking gas burner assembly including a distributor (30), a gas manifold (50) and a cup (40), the cup (40) being located between the gas manifold (50) and the distributor (30). The gas manifold is spaced from the cup. The invention provides a burner assembly having at least a cap (220) and a distributor (30) on which the cap (220) is mounted, the distributor (30) including an internal and an external crown of flame ports, and at least one cross lighting passage (37) there between. The cap (220) includes an aperture (222) there through, which is adapted to be positioned over the cross lighting passage (37) when the cap (220) and distributor (30) are assembled.

21 Claims, 16 Drawing Sheets

(56) References Cited

U.S. PATENT DOCUMENTS

| | | | | | |
|---|---|---|---|---|---|
| 3,638,635 | A * | 2/1972 | Drennan | 126/41 R |
| 4,354,478 | A * | 10/1982 | Contini | 126/39 E |
| 4,626,196 | A * | 12/1986 | Stohrer, Jr. | 431/264 |
| 5,002,038 | A * | 3/1991 | Riehl | 126/39 R |
| 5,186,158 | A | 2/1993 | Ferlin | |
| 5,401,164 | A * | 3/1995 | Yen | 431/354 |
| 5,405,263 | A * | 4/1995 | Gerdes et al. | 431/354 |
| 5,639,232 | A | 6/1997 | Bogenschutz | |
| 5,676,539 | A * | 10/1997 | Draper | 431/354 |
| 5,690,483 | A * | 11/1997 | Oda et al. | 431/266 |
| 5,842,849 | A * | 12/1998 | Huang | 431/284 |
| 6,030,207 | A * | 2/2000 | Saleri | 431/354 |
| 6,032,662 | A * | 3/2000 | Taplan et al. | 126/39 R |
| 6,132,205 | A | 10/2000 | Harneit | |
| 6,209,534 | B1 * | 4/2001 | Taplan | 126/39 R |
| 6,244,263 | B1 * | 6/2001 | Schlosser et al. | 126/39 R |
| 6,263,868 | B1 * | 7/2001 | Koch et al. | 126/39 R |
| 6,322,354 | B1 * | 11/2001 | Carbone et al. | 431/284 |
| 6,325,619 | B2 * | 12/2001 | Dane | 431/284 |
| 6,332,460 | B1 * | 12/2001 | Paesani | 126/39 R |
| 6,589,046 | B2 * | 7/2003 | Harneit | 431/266 |
| 6,599,122 | B2 * | 7/2003 | Hunault et al. | 431/354 |
| 6,780,009 | B2 * | 8/2004 | Harneit | 431/354 |
| 2001/0010897 | A1 * | 8/2001 | Dane | 431/266 |
| 2001/0041316 | A1 * | 11/2001 | Haynes et al. | 431/278 |
| 2003/0039937 | A1 | 2/2003 | Hunault | |
| 2003/0136395 | A1 * | 7/2003 | Distaso | 126/39 R |
| 2003/0170580 | A1 * | 9/2003 | Ferlin et al. | 431/266 |
| 2004/0072112 | A1 * | 4/2004 | Harneit | 431/266 |
| 2004/0234915 | A1 * | 11/2004 | Koch et al. | 431/278 |

FOREIGN PATENT DOCUMENTS

| | | |
|---|---|---|
| EP | 0 751 352 | 1/1997 |
| EP | 0 903 538 | 3/1999 |
| EP | 0 976 984 | 2/2000 |
| EP | 1 406 043 | 4/2004 |
| EP | 1 469 256 | 10/2004 |
| FR | 829 485 | 6/1938 |
| GB | 2 256 268 | 12/1992 |
| GB | 2256266 | 12/1992 |
| JP | 2003083516 | 3/2003 |
| WO | 00/40900 | 7/2000 |
| WO | 0040900 A | 7/2000 |
| WO | 2005/073630 | 8/2005 |

OTHER PUBLICATIONS

International Search Report (PCT/SE2005/001620) dated Mar. 29, 2006.

Mexican Office action for MX/a/2007/005147, dated Apr. 28, 2011.

Japanese Office action for 2007-538862, dated Jun. 21, 2011.

* cited by examiner

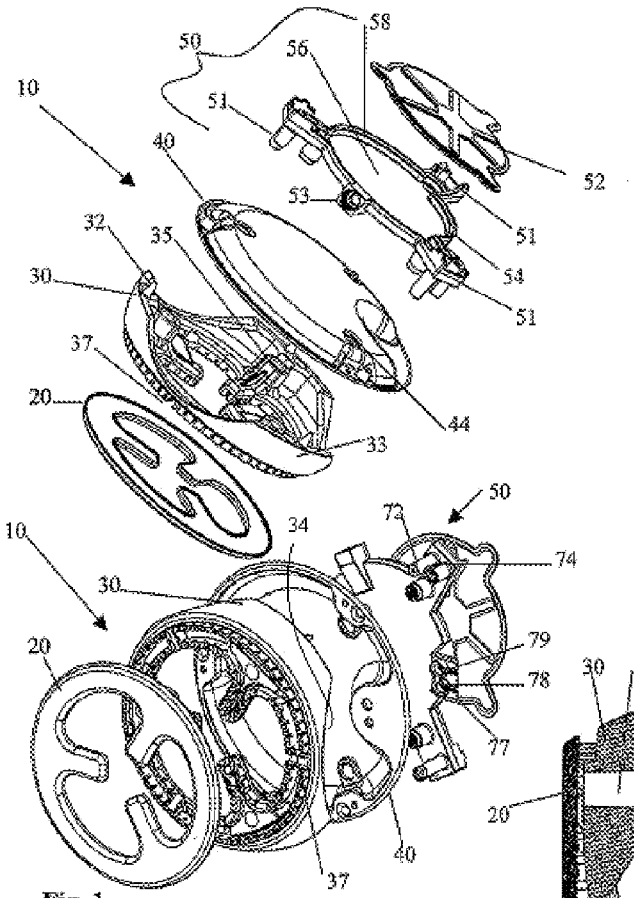
Fig. 2
Fig. 1
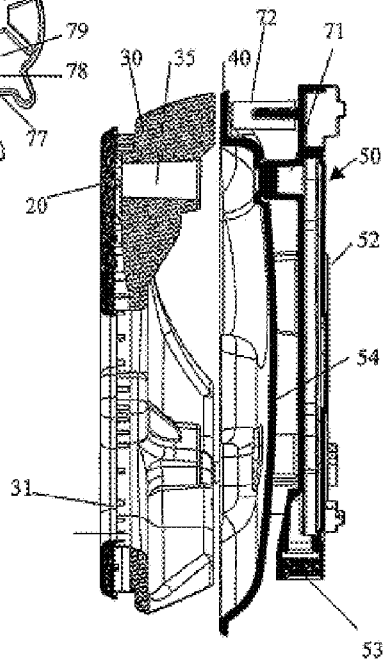
Fig. 4
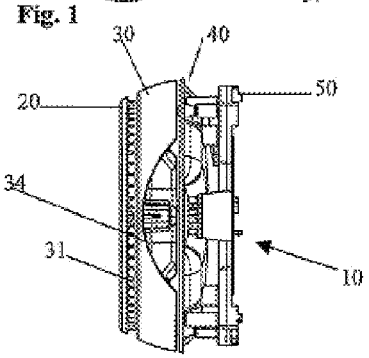
Fig. 3

COOKING GAS BURNER

This application claims the benefit of International Application Number PCT/SE2005/001620, which was published in English on May 4, 2006.

FIELD OF THE INVENTION

The present invention relates to an improved cooking gas burner which can be formed as part of a cooking hob, or separate therefrom and attached thereto.

BACKGROUND OF THE INVENTION

After a gas cooking burner is lit the gas supply to the burner is heated. This heating of the gas supply is unintentional, and results in a reduction of gas flow to the burner, thereby reducing the power delivered by the burner. The effect is apparent whether or not the gas has been premixed with primary air. The extent of the power loss is related primarily to the temperature of the gas flowing to the burner.

SUMMARY OF THE INVENTION

The present invention provides a cooking gas burner assembly including a distributor, a gas manifold and a cup, said cup being located between said gas manifold and said distributor.

The distributor can include a primary air and gas supply mixing means.

The distributor can include apertures therein to allow primary air to be drawn into said mixing means.

The cup can form the underside of a passage which allows primary air to be drawn into said mixing means.

The gas manifold can be spaced from said cup.

The gas manifold and the cup can be spaced from each other by means of posts extending vertically between said manifold and said cup.

The posts can include a wall of one or more an upwardly directed passage(s) from said manifold by which said manifold delivers supply gas to said mixing means.

The minimum spacing between said manifold and said cup is approximately 5 millimeters.

The distributor has a contact area with said cup and or hob of between 5 and 20 square millimeters.

The distributor can include a skirt therearound, said skirt including said apertures, whereby a bottom edge of said apertures is provided by said cup.

The portions of said skirt which do not include said apertures are portions of the sub-assembly which do not make contact with said cup. These portions are spaced from said cup by between 5 and 20 millimeters.

The manifold can have a two piece construction.

The gas manifold can have a body portion having a generally planar construction.

At locations of contact between said distributor and said cup, and or between said cup and said manifold, there are provided heat insulating members.

The cup can provide a means to secure said cooking gas burner to a hob. Alternatively, the cup can be integrally formed in a hob of a cooking appliance.

The distributor can includes downwardly extending spigots to engage said cup.

The spigots can terminates in one of: a point; a flat surface; a part spheroidal surface.

The cup can includes a recess to receive said spigots.

The recess or said spigot is shaped so that as said distributor changes dimensions due to thermal expansion there is substantially no change in the contact area of said cup and said distributor.

The recess can have an elongated shape. The elongated shape can have a major axis which substantially lies on or is substantially parallel to a virtual radius emanating from a centre of said burner.

The recess can be elliptical in cross section.

The recess can have an elongated, generally horizontal base, said base being preferably of the same general shape as said recess.

The recess and the spigot can each have a tapered construction.

The recess can have a shallower taper than said spigot.

The spigot can be able to slide over a surface of said cup.

The present invention also provides a method of assembling a distributor and a cup in a cooking gas burner assembly, said method including the steps of providing: said distributor with downwardly extending spigots, providing said cup with recesses to receive said spigots, said recesses including a base surface, said recesses being sized and or shaped whereby thermal expansion of said distributor results in substantially no increase in the contact surface between said cup and distributor, when said distributor is hot compared to when it is cold.

The method can be such that the base surface provides a bearing surface over which an extremity of said spigot can slide.

The recess can be elongated or elliptical such that a major axis thereof lies in a generally radial direction relative to a centre of said distributor.

The present invention further provides a burner assembly having at least a cap and a distributor on which said cap is mounted, said distributor including an internal and an external crown of flame ports, and at least one cross lighting passage there between, said cap including an air aperture there through which is adapted to be positioned over said cross lighting passage when said cap and distributor are assembled.

The air aperture through said cap can be converging in a direction from an upper to a lower surface of said cap.

The air aperture can have a generally D-shaped configuration.

The curve of the D-shaped configuration can be located at a radially inward location relative to a generally circular shape of said cap.

The present invention further provides a cooking gas burner assembly having a distributor and a first formation to support said distributor in said assembly, said distributor and said first formation including spigots and recesses to allow said first formation to support said distributor, said recesses including a surface being sized and or shaped whereby thermal expansion of said distributor results in substantially no increase in the contact surface area between said first formation and distributor, when said distributor is hot compared to when it is cold.

The distributor can have said spigots downwardly extending therefrom, while said first formation can includes said recesses to receive respective ones of said spigots.

Alternatively said distributor can have said recesses to receive said spigots extending away from said first formation, while said first formation includes said spigots extending upwardly away therefrom.

The first formation can be a cup, or the first formation can be a hob or the first formation can be a hob which includes a cup formed therein.

The spigots can terminate in one of: a point; a flat surface; a part spheroidal surface.

The recesses and or the spigots can be shaped so that as said distributor changes dimensions due to thermal expansion there is substantially no change in the contact area of said first formation and said distributor.

The recesses can have an elongated shape. The elongated shape can have a major axis which substantially lies on or is substantially parallel to a virtual radius emanating from a centre of said burner.

The recesses are preferably elliptical in shape.

The recesses can have an elongated, generally horizontal base or surface, said base or surface being preferably of the same general shape as said recess.

The recesses and the spigots can each have a tapered construction.

The recesses can have a shallower taper than said spigots.

Each said spigot can be able to slide over a respective surface of said cup.

Each base or surface can provides a bearing surface over which an extremity of a respective one of said spigots can slide.

BRIEF DESCRIPTION OF THE DRAWINGS

Embodiments of the present invention, will now be described by way of example only, with reference to the accompanying drawings in which:

FIG. 1 illustrates an exploded perspective view of a cooking gas burner;

FIG. 2 illustrates an exploded view of the burner of FIG. 1 from a different angle;

FIG. 3 illustrates an elevation of the burner of FIG. 1 in an assembled condition, the view aligned with the igniter and thermocouple mounting;

FIG. 4 illustrates a cross section through the burner of FIG. 3;

DETAILED DESCRIPTION OF THE EMBODIMENTS

Figure 5:
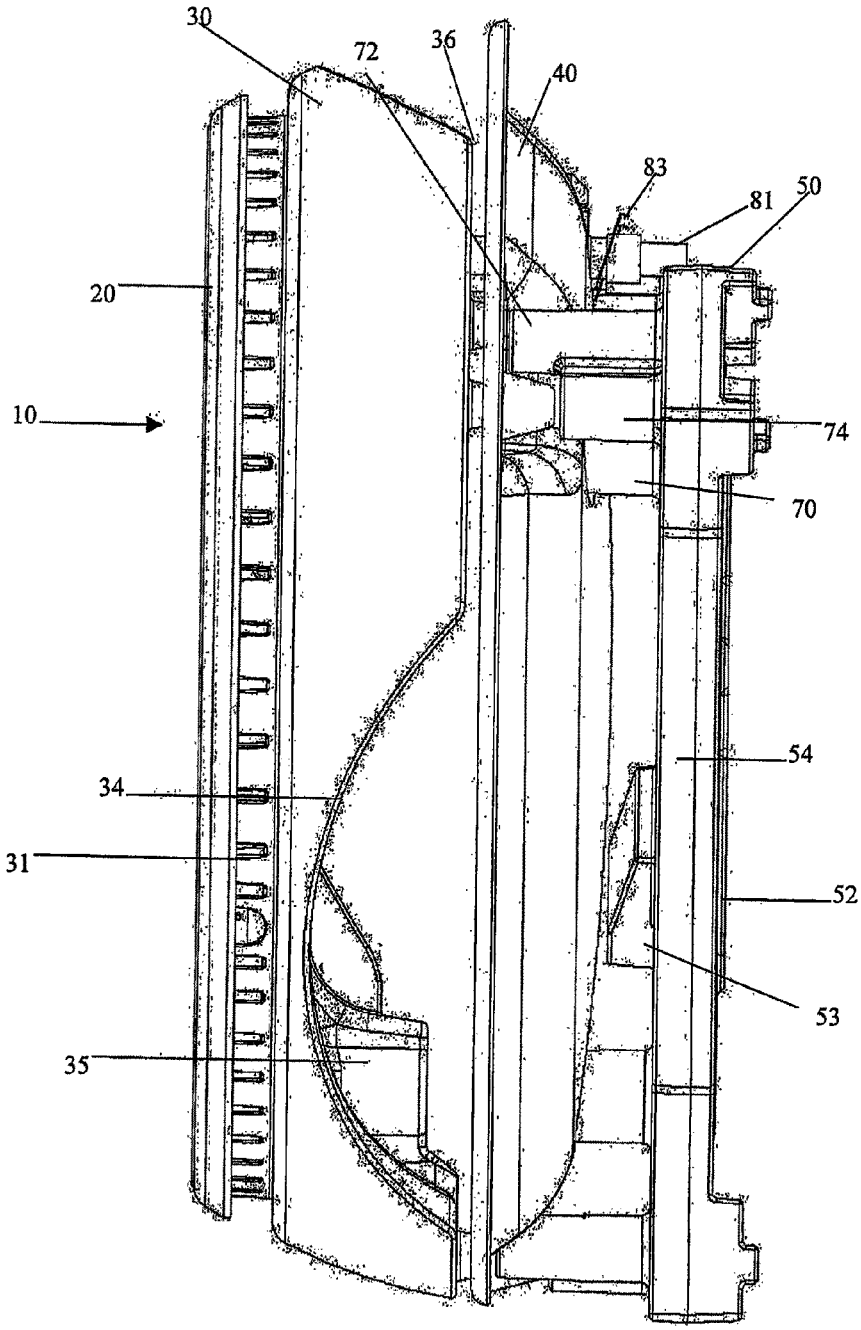
FIG. 5 illustrates a rear elevation of the burner of FIG. 1.
Figure 6:
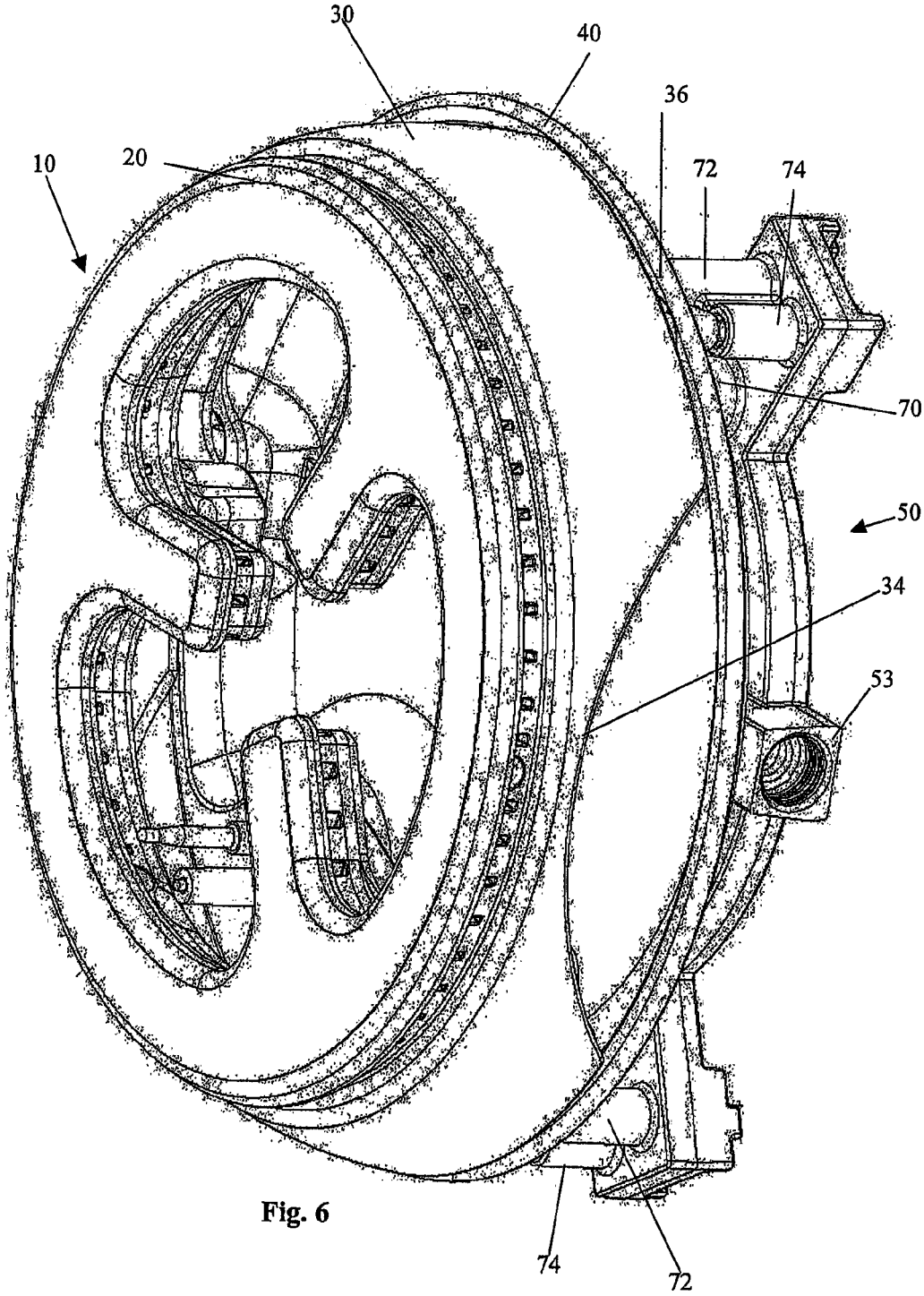
FIG. 6 illustrates a front upper perspective view of the assembled burner of FIG. 3
Figure 7:
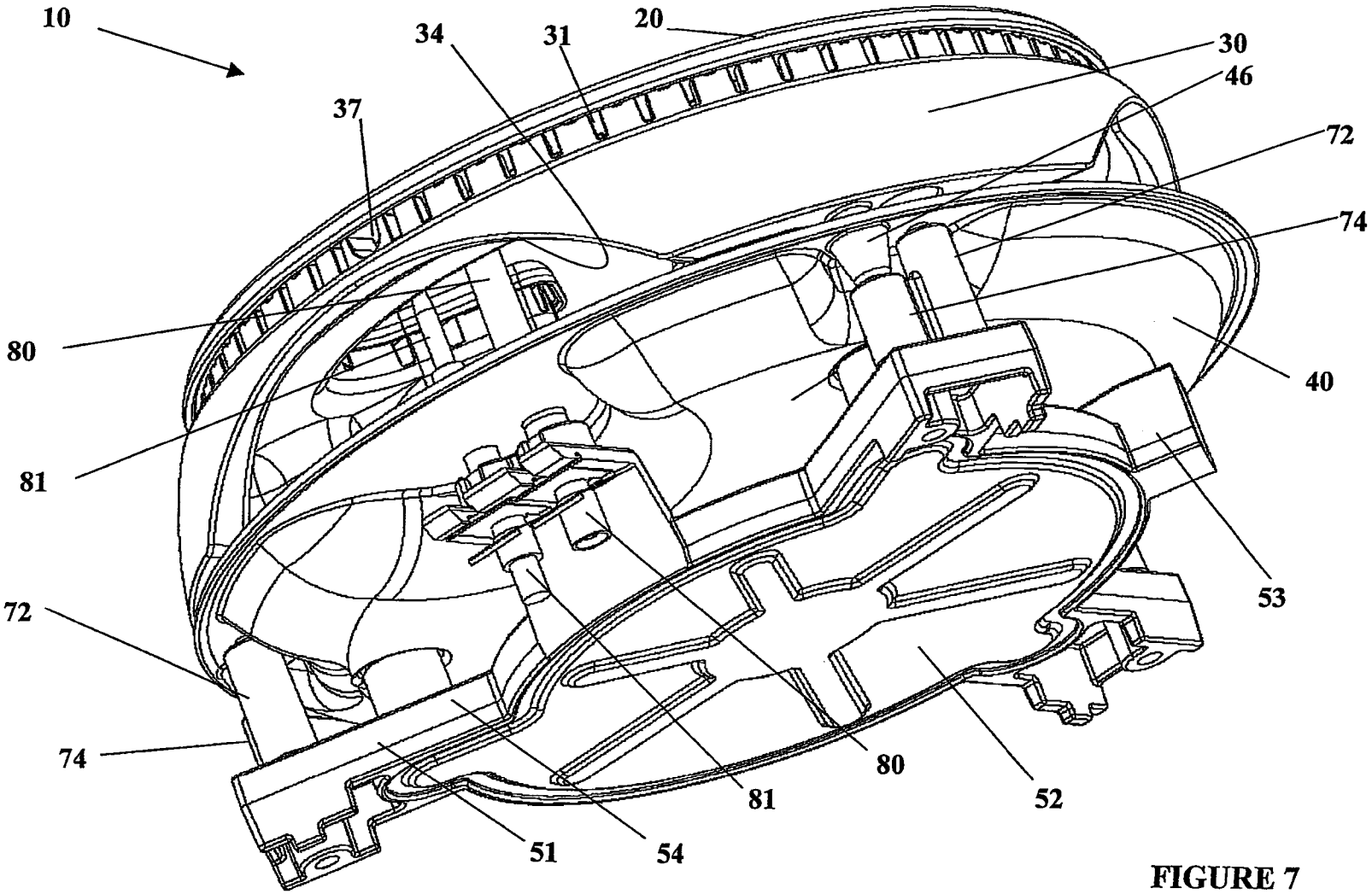
FIG. 7 illustrates a lower perspective showing the igniter and thermocouple mounting.

Illustrated in FIGS. 1 to 9 is a cooking gas burner 10 which has a cap 20, a crown or distributor 30, a cup 40 and a gas manifold 50.

The cap 20 and distributor 30 together form a sub-assembly such that the grooves in the distributor 30, on the upper surface thereof, form flame ports 31 when the cap 20 is positioned thereon.

The gas manifold 50 is made from a two piece construction. A first main piece is a base top 54 having a generally circular top 56 surrounded by a circumferential wall 58. Equispaced and circumferentially located around the top 56 are three sets of post formations 51, while between two such sets of post formations 51 is a female threaded gas supply inlet 53. The inlet 53 can be connected to a gas supply to supply gas to the burner 10.

The volume enclosed by top 56 and the wall 58 is closed off by the addition of a second piece being a base bottom 52 which can be attached to the base top 54 by means of silicone of an appropriate grade and a portion of the wall 58 being bent, swaged or clinched over to lock the bottom 52 to the top 54. The rim of the base bottom 52 will thus be sealed and secured with either the wall 58 or a surface adjacent thereto.

Figure 8:
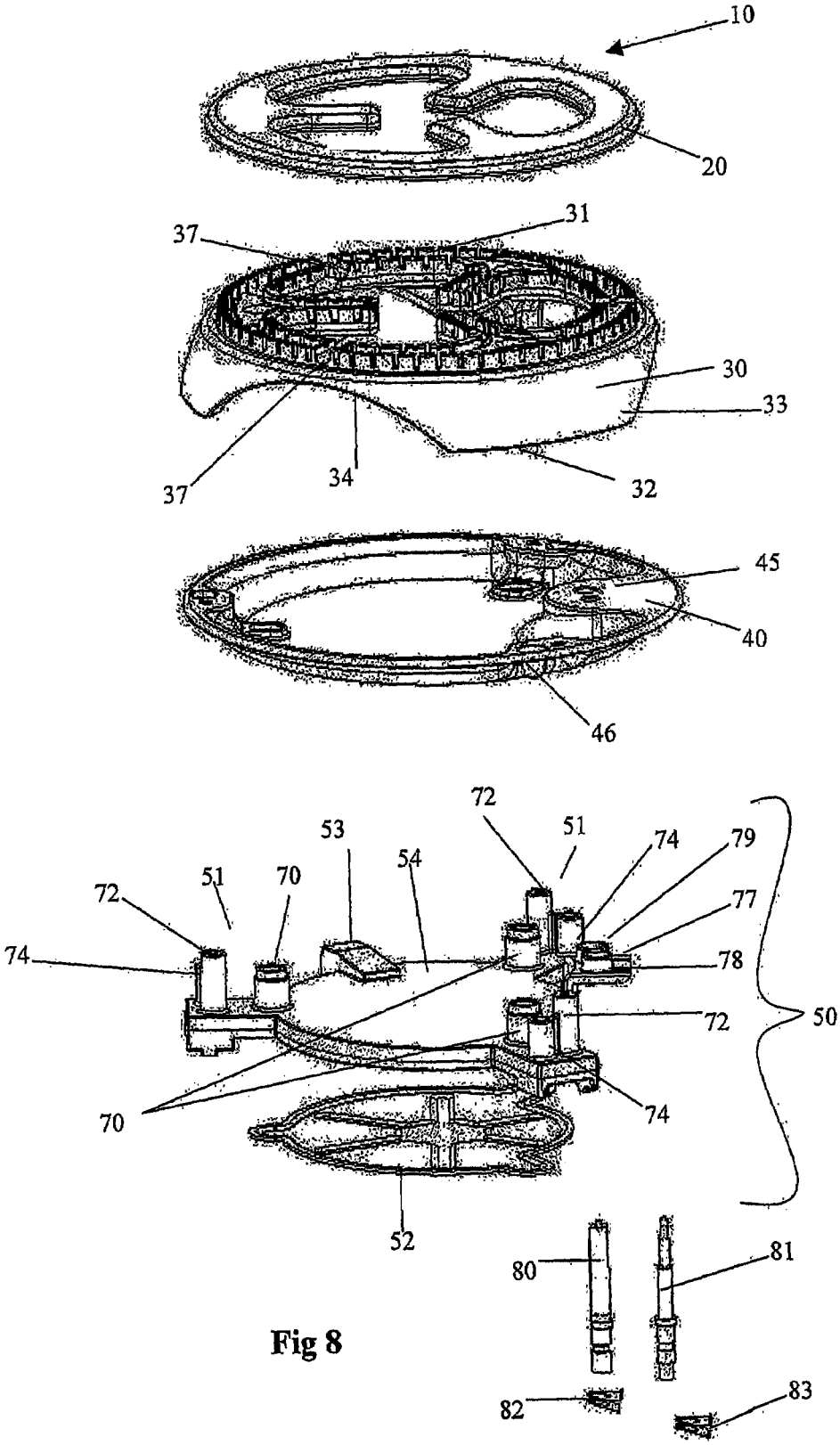
FIG. 8 illustrates a more detailed exploded perspective view by comparison to FIGS. 1 and 2.

As is best seen in FIGS. 1 and 8, the post formations 51 comprise a radially inwardly positioned injector post 70 which engages the underside of the base of the cup 40. Outside posts 72 and 74 are also provided. The post 72 engages the underside of the hob 141 (see FIGS. 16 and 17) while the hob 141 will be sandwiched between cup 40 and the post 72, radially outwardly of the location of engagement of the injector post 70. The shorter post 74 is redundant with respect to assembly of the burner 10, but serves a function in respect of the burner 100 of FIGS. 10 to 15, as will be described below.

By the rim of the cup 40 making contact with the hob 141 (see FIGS. 16 and 17), the hob 141 can act as a heat sink to help draw heat away from the cup 40, which otherwise may be detrimentally transmitted to the manifold 50 or distributor 30 during use of the burner 10.

Figure 9:
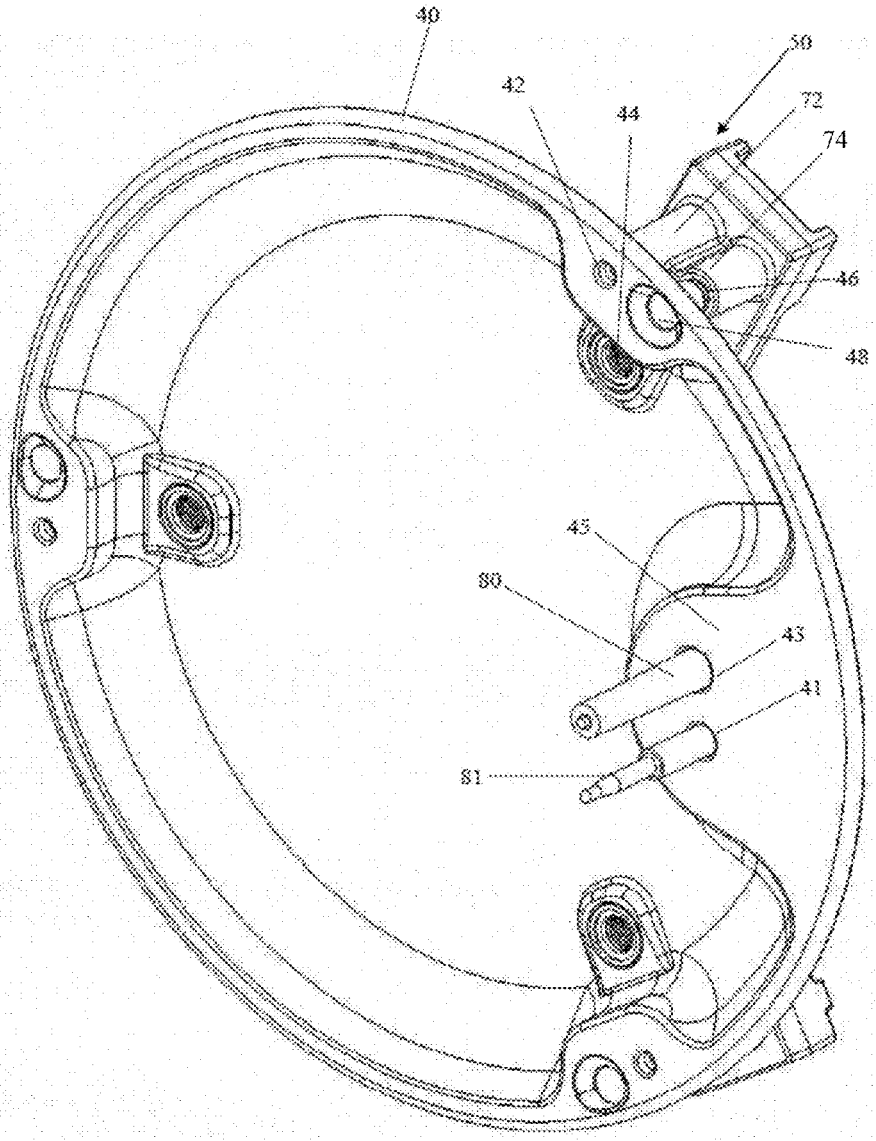
FIG. 9 illustrates an upper perspective view of the cup of FIG. 1.
Figure 11:
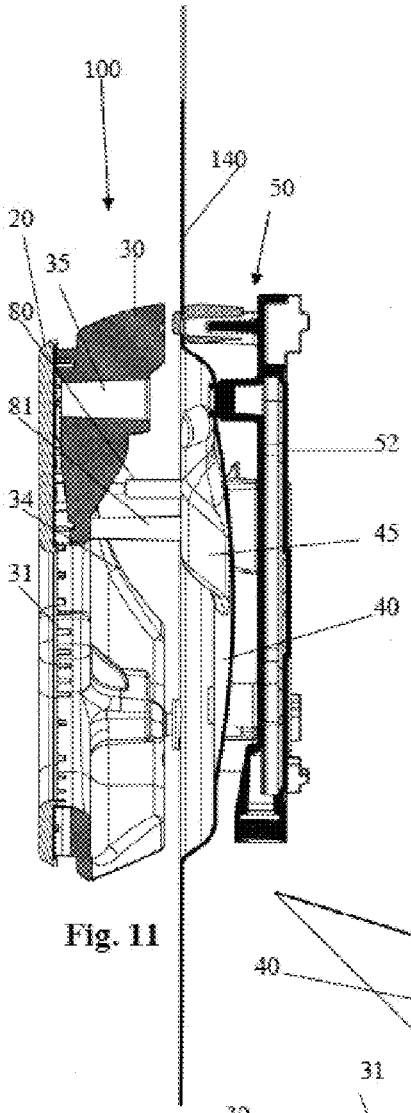
FIG. 11 illustrates a cross section through the burner of FIG. 10.
Figure 10:
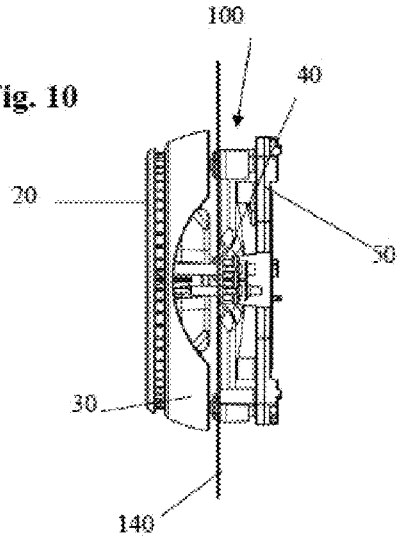
FIG. 10 illustrates an elevation of another burner similar to that of FIG. 1 in an assembled condition, the view aligned with the igniter and thermocouple mounting.
Figure 12:
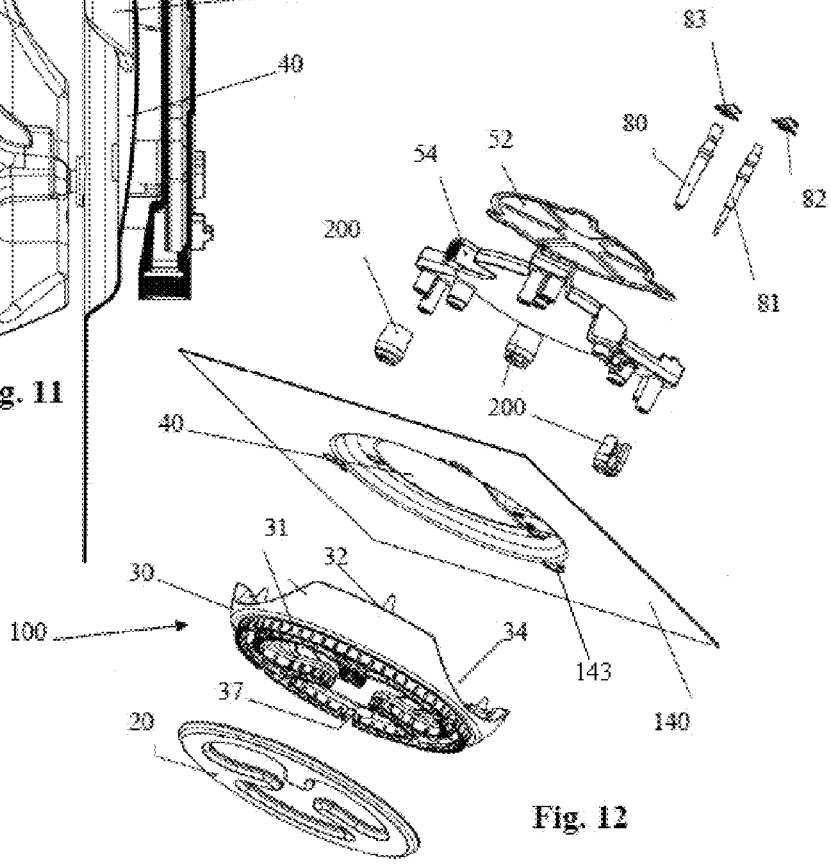
FIG. 12 illustrates an exploded perspective view of the burner of FIG. 10.
Figure 13:
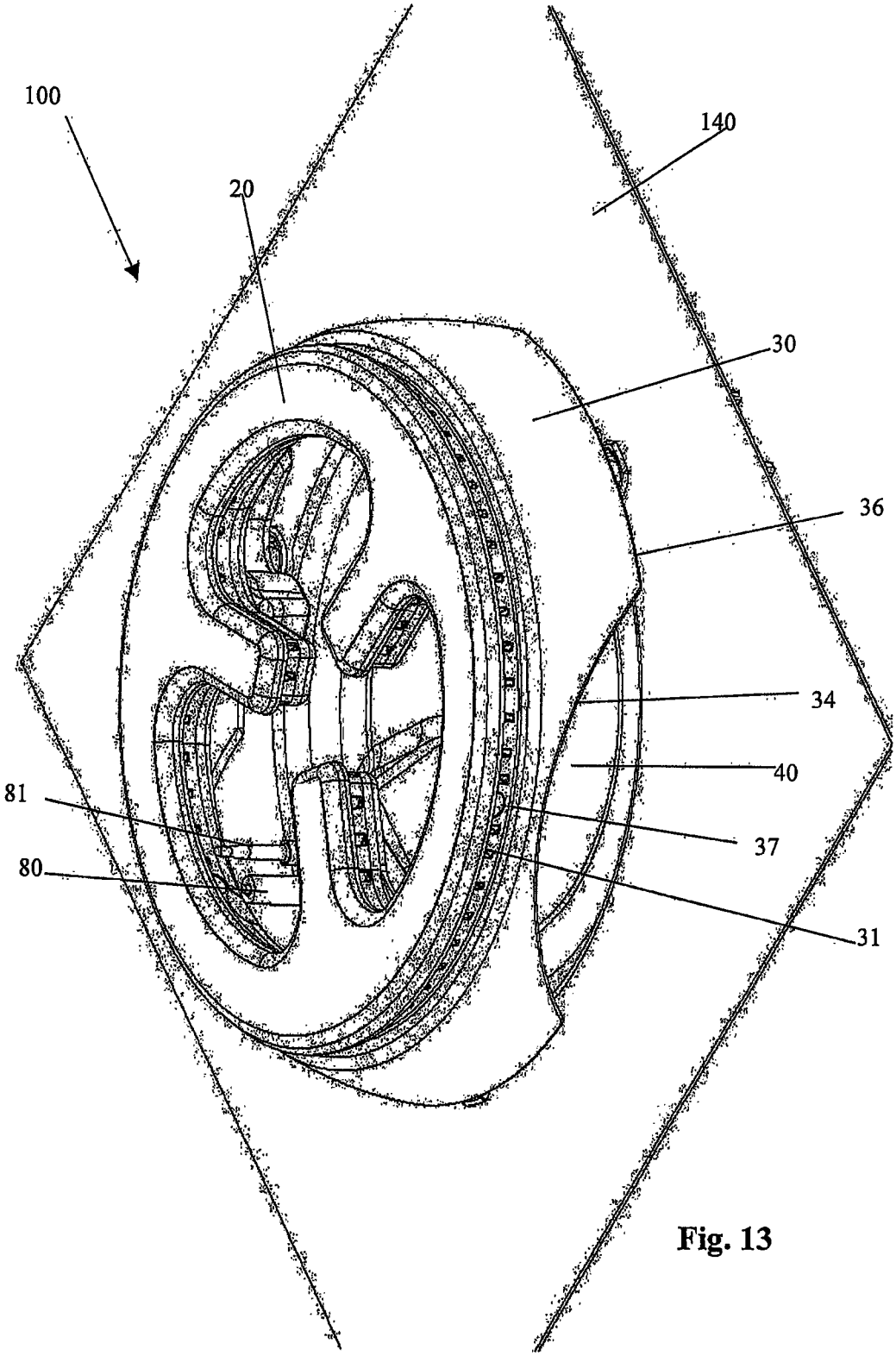
FIG. 13 illustrates a perspective upper view of the burner of FIG. 10.
Figure 14:
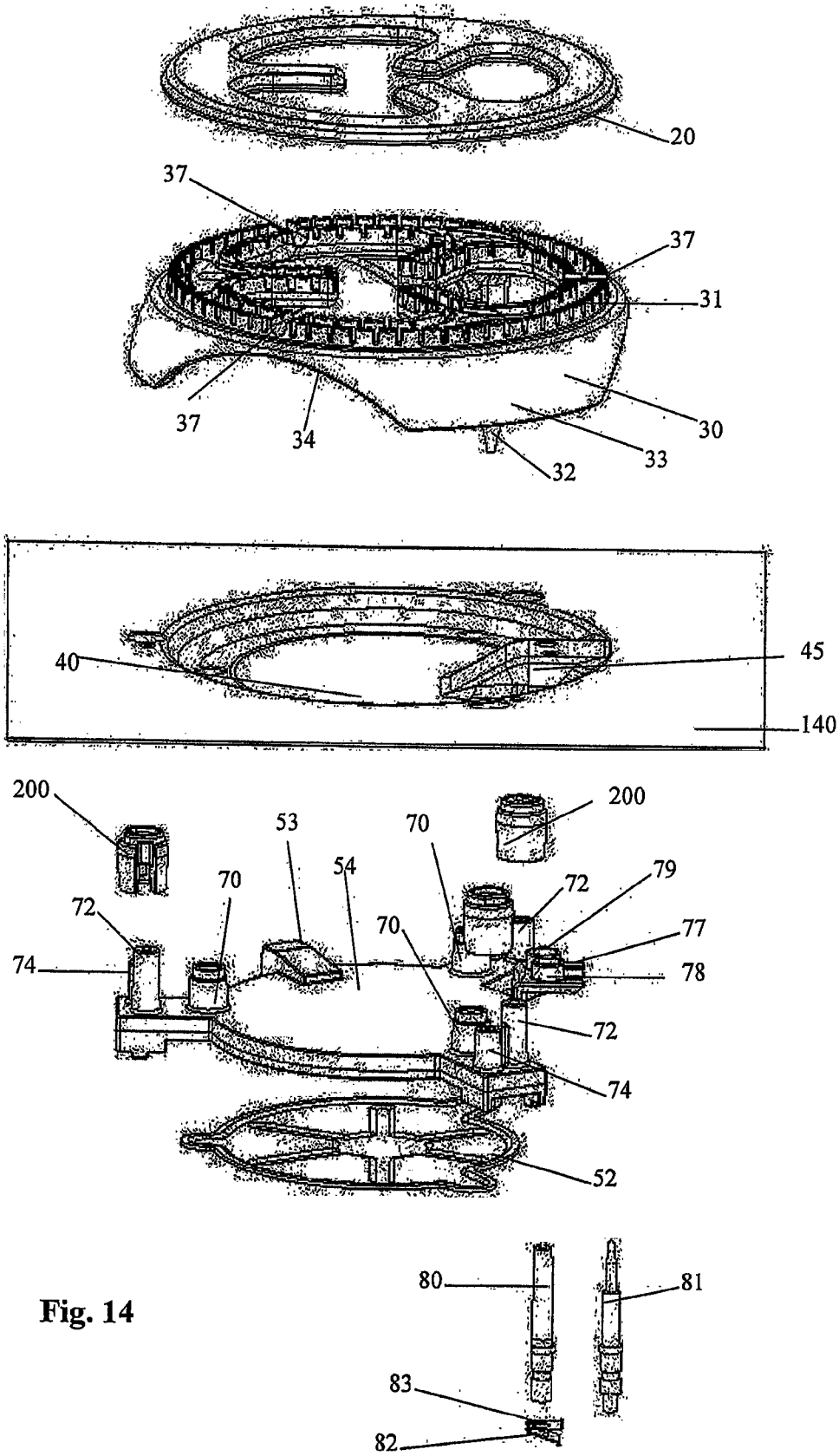
FIG. 14 illustrates a more detailed exploded perspective view by comparison to FIG. 12.
Figure 15:
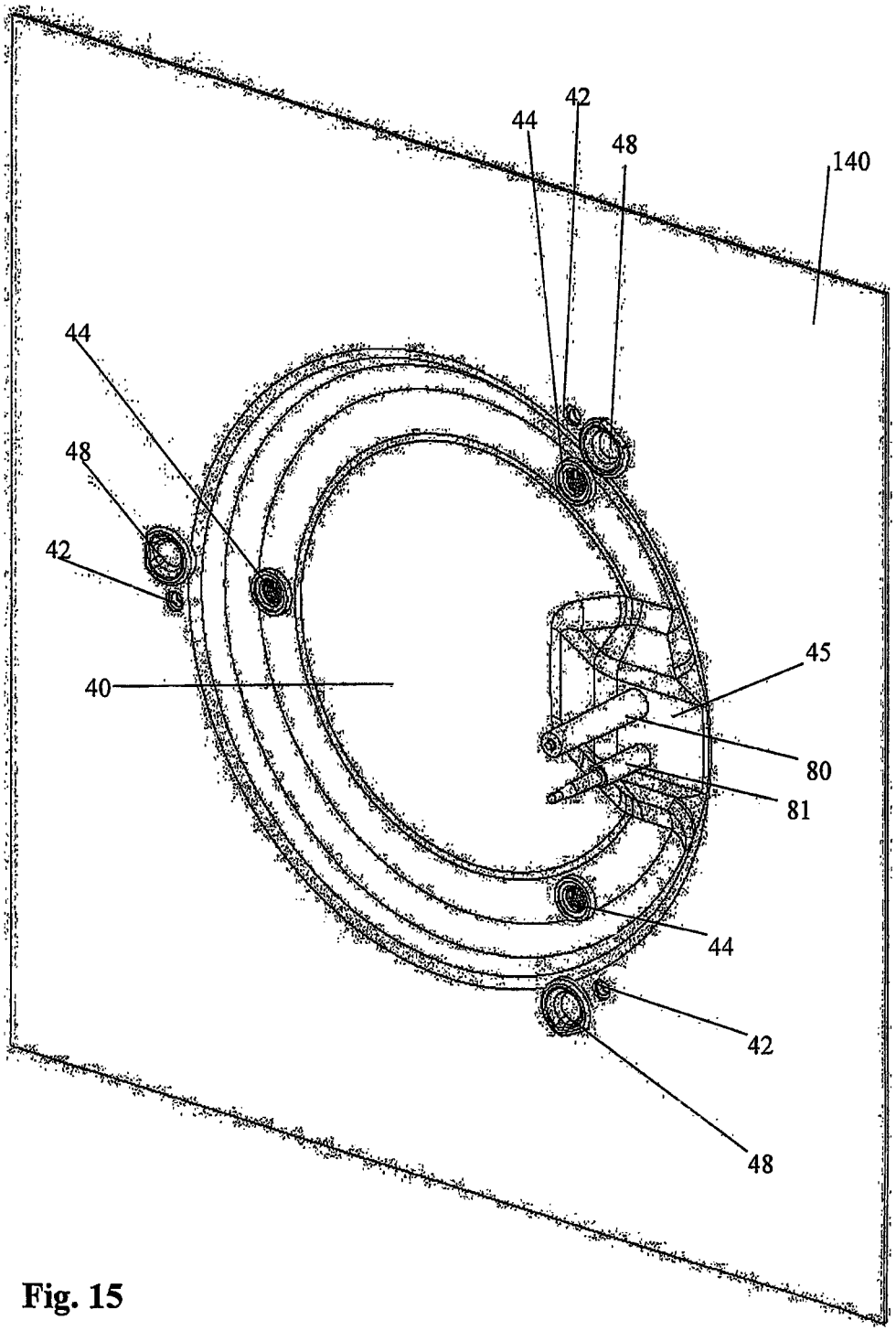
FIG. 15 illustrates a detailed perspective view of the cup formed in the hob surface to which the flame port assembly and the gas manifold can be assembled.
Figure 16:
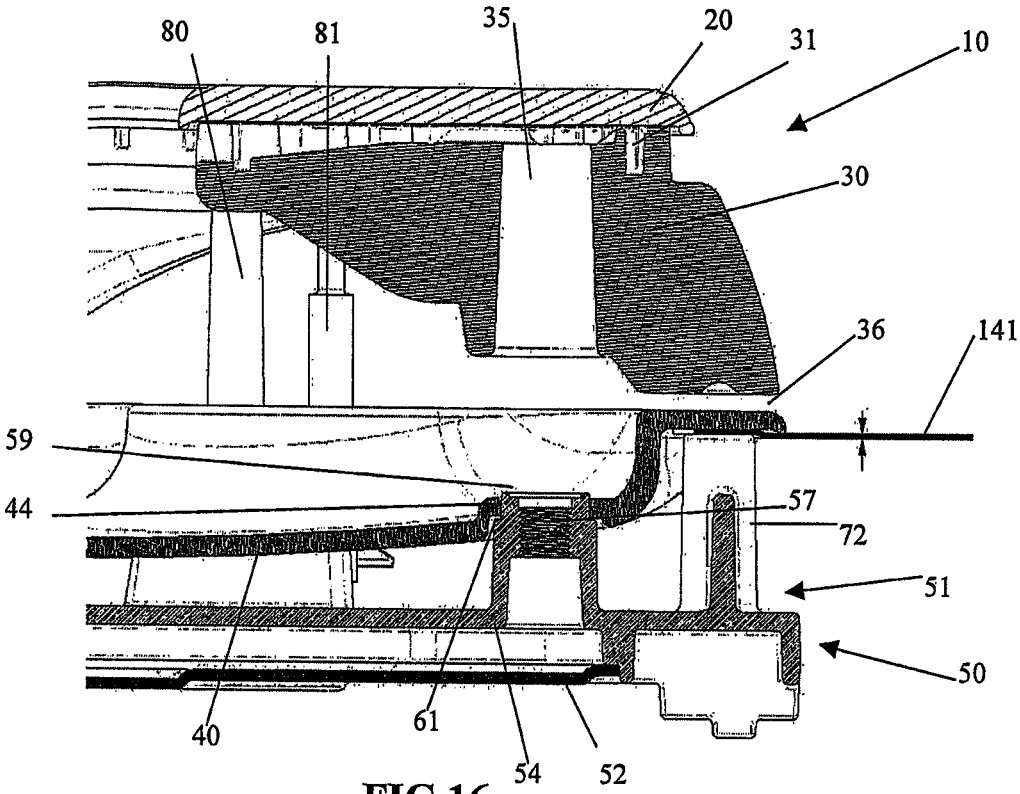
FIG. 16 illustrates the injector portion of the burner of FIG. 4 in cross section showing assembly with a hob of 0.6 mm in thickness.

As can be seen from FIG. 9, the cup 40 is joined to the hob 141 and the post 72 by means of screws (not illustrated) which pass through holes 42 in the cup 40 (and an aperture in the hob 141 which is not illustrated) to engage the taller post 72. When so secured, the inward injector post 70 is located immediately below and aligned with aperture 44 inwardly located on the cup 40. It can be seen from FIGS. 16 and 17, that the injector post 70 has the female threaded end 57 with a reduced diameter rim 59. The rim 59 is sized so as to pass into the aperture 44. The height of the rim 59 above the larger diameter shoulder 61 allows the assembly of the cup 40 and manifold 50 to accommodate different sized hobs 141. In FIG. 16 the thickness of the hob 141 can be for example 0.6 mm thick while in FIG. 17, it can be seen that with for example a thickness of hob 141 of approx. 1.2 mm the height of the rim 59 accommodates this difference in thickness whereby the reduced diameter rim of injector post 70 will still be correctly located within the aperture 44.

Figure 17:
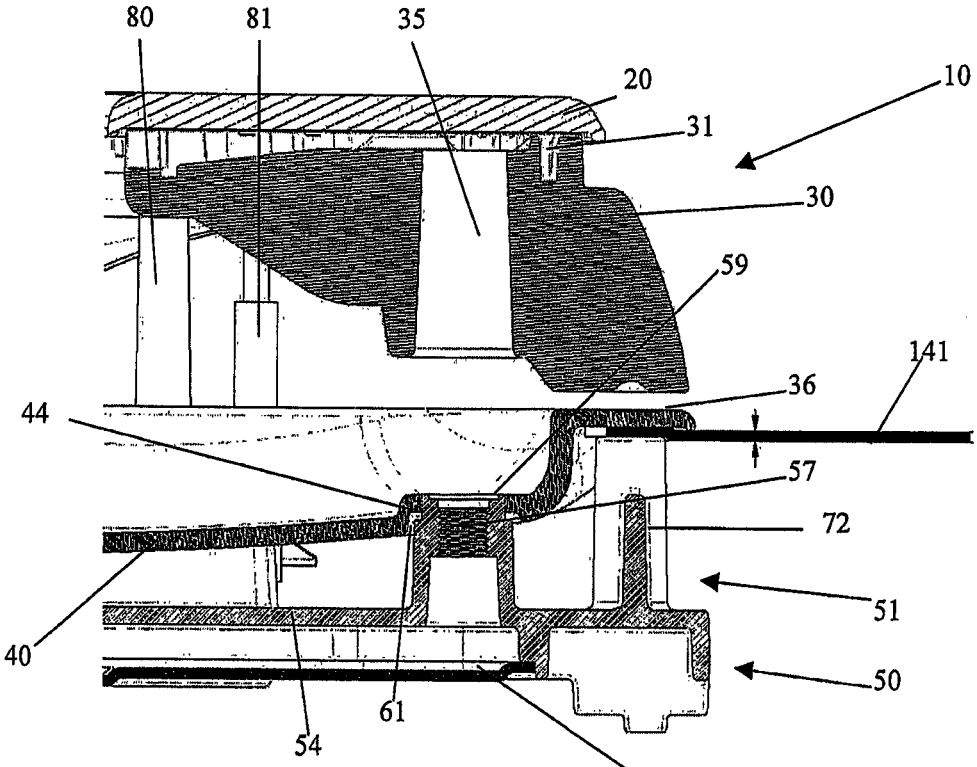
FIG. 17 illustrates a cross section similar to that of FIG. 16, showing assembly to a hob of 1.2 mm in thickness.
Figure 20:
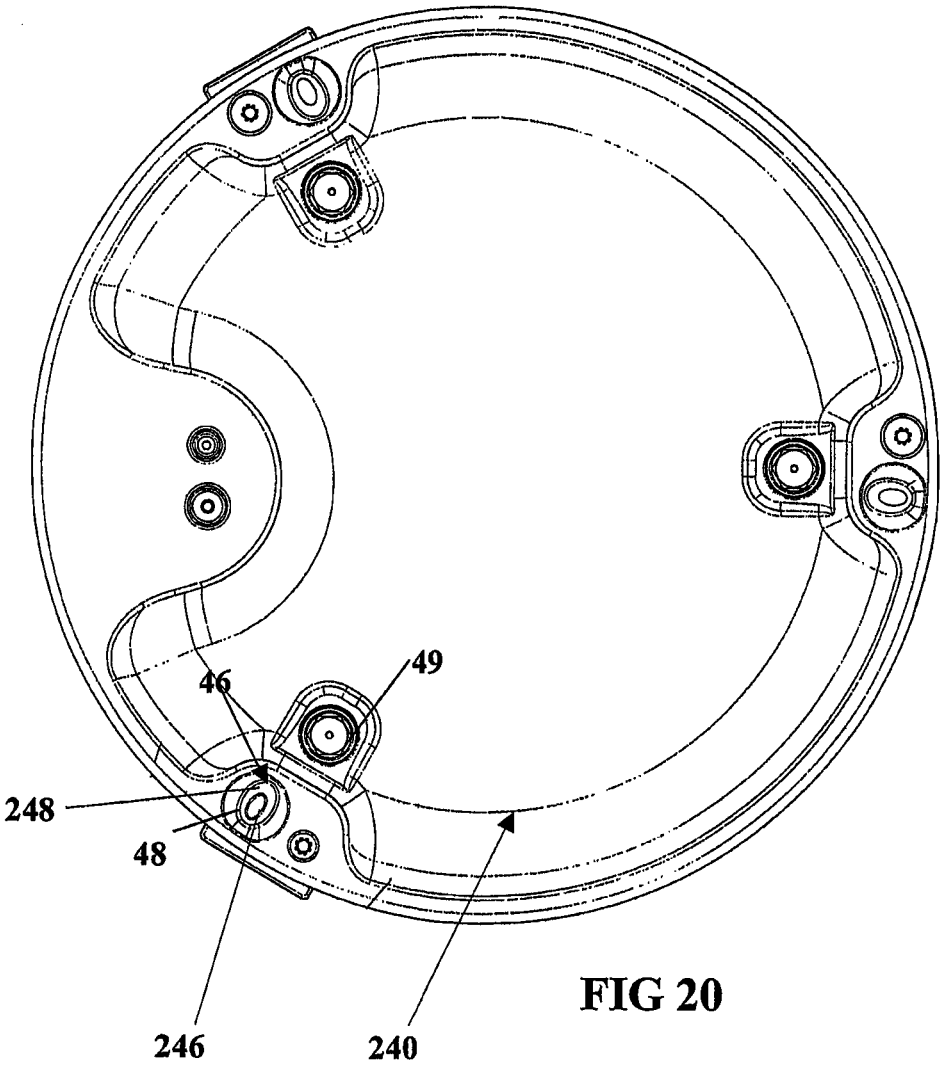
FIG. 20 illustrates a plan view of a modified cup showing elliptical tapering recesses or formations to receive spigots from the distributor.
Figure 22:
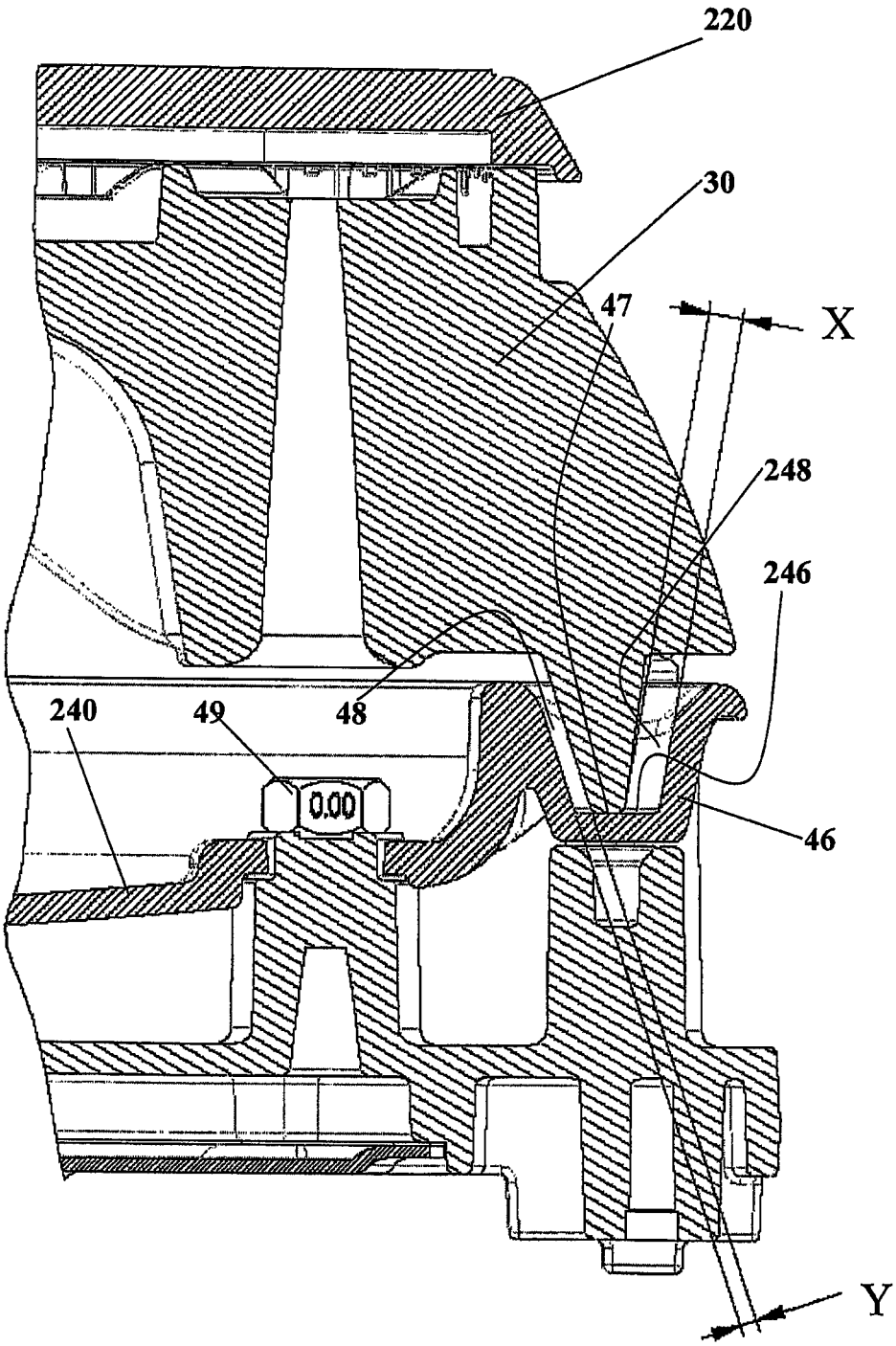
FIG. 22 illustrates a cross section through elliptical tapering formations along the line XXII-XXII of FIG. 23.
Figure 24:
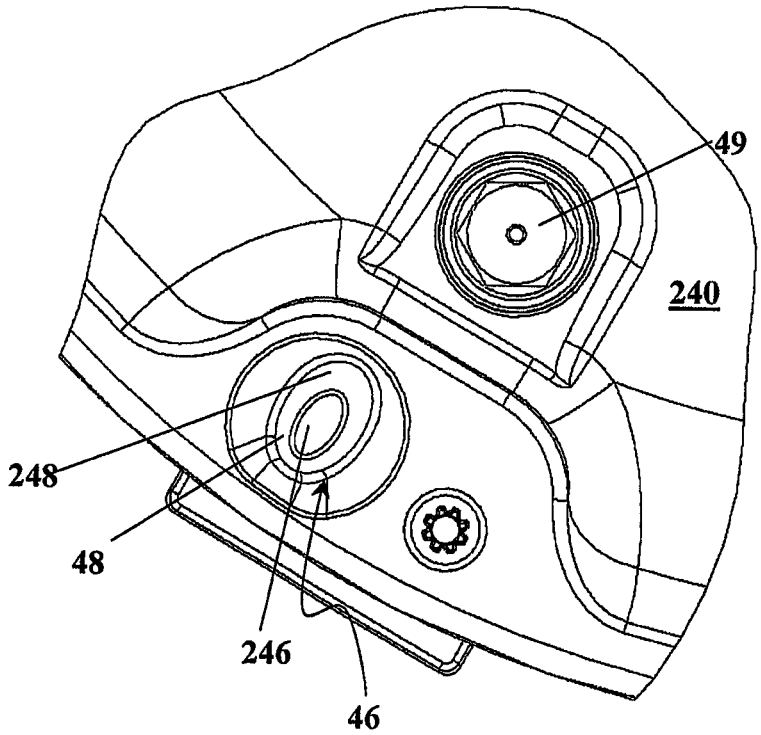
FIG. 24 illustrates in detail a part of FIG. 20 showing a recess in detail in plan view.

An injector or nozzle 49 which is illustrated in FIGS. 20, 22 and 24, is screwed into the female threaded end 57 of the injector post 70 (see FIGS. 16 and 17). The nozzle 49 will have its outlet aperture above the level of the cup 40. By this means any liquid which spills into the cup 40 during use will not adversely affect the operation of the injector or nozzle 49 until the level of liquid rises above the height of the outlet aperture of such a nozzle 49.

The cup 40 has a downwardly extending formation 46 which has an upwardly directed concave or blind recess 48. The recess 48 receives a spigot 32, which extends downwardly from the rim of the distributor 30. By the formations 46 and the spigots 32, the distributor 30 will sit over the cup 40, so that the aperture 44 will be directly below and aligned with the inlet to a vertically oriented mixing chamber 35 on the underside of the distributor 30.

Figure 21:
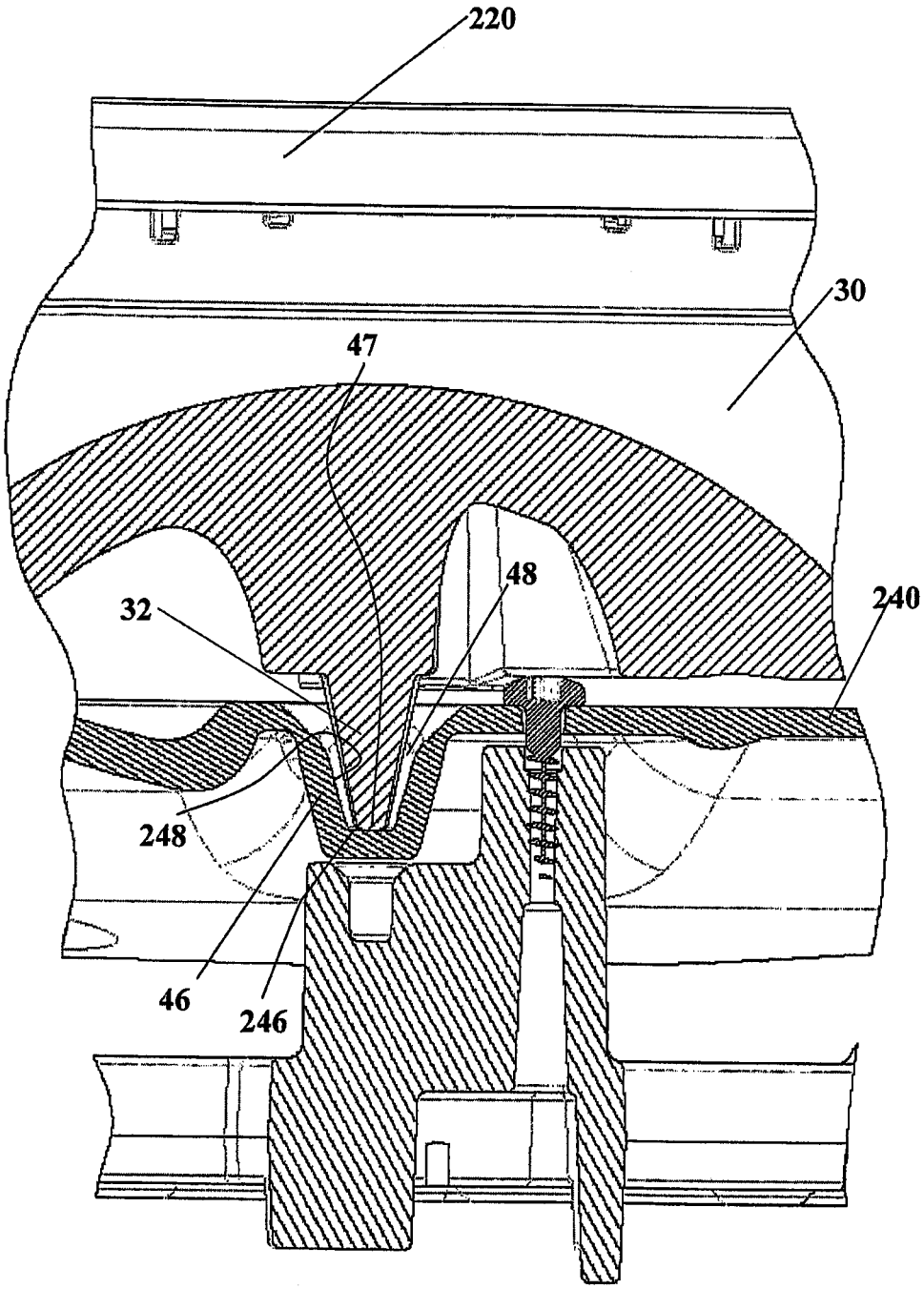
FIG. 21 illustrates a cross section through elliptical tapering formations along the line XXI-XXI of FIG. 23.

The spigots 32 sitting in the respective formations 46 will provide a contact surface area of approximately 2.5 square millimeters per spigot 32, by means of their respective bases 47 (see FIGS. 21 and 22). This greatly reduces the transfer of heat by conduction from the distributor 30 to the cup 40.

The mixing chamber 35 receives gas supply from a passage 71 through the injector post 70, which passage 71 communicates with the volume of the gas manifold 50, between the base top 54 and base bottom 52. The gas under pressure is injected into the mixing chamber 35 via the ports 44 in the cup 40, where primary air can be entrained which enters beneath the distributor 30 via the apertures 34 and gap 36.

The gas and air mixture is distributed to the flame ports 31 in the distributor 30 as is described in WO2005/073630 which is incorporated herein by reference.

On a peripheral portion of the gas manifold 50 is an L-shaped bracket 77 which has apertures 78 and 79 to mount spark plug or igniter 80 and a thermocouple 81 respectively. The igniter 80 and the thermocouple 81 are held in position on the gas manifold 50 by means of respective clips 82 and 83. The bracket 77 and apertures 78 and 79 ensure that the igniter is positioned near to the inner flame ports 31 in the distributor 30, when the components are assembled. The outer flame ports 31 are ignited by flame propagation through cross lighting gaps 37 which are equi-spaced around the top of the distributor 30. If desired additional cross lighting facilitation can be achieved by providing apertures in the cap 20 directly above cross lighting gaps 37, as is later described with respect to FIGS. 18, 19 and 23.

The cup 40 has apertures 41 and 43 through which pass the igniter 80 and the thermocouple 81. While there is no need for sealing between the igniter 80 the thermocouple 81 and their respective apertures 43 and 41, if desired, an O-ring, grommet or other sealing means can be used.

Surrounding the apertures 41 and 43 is a boss 45 of cup material which serves the purpose of allowing the L-shaped bracket 77 to sit snugly under the cup 40, without making contact therewith. The boss 45 also provides a surface through which passes the igniter 80 and thermocouple 81 which surface is at the maximum height of the cup relative to the centre or lowest point on the cup. By this means any spillage into the cup will not pass through the apertures 41 and 43 until such time as the level of the liquid in the cup has achieved the height of the boss 45.

The distributor 30 includes 3 equi-spaced apertures 34 which allow primary air to enter the underside of the distributor 30. Further once assembled, the spigot 32 being located inside the formation 46 will provide a gap 36 beneath the edge of the skirt 33 of the distributor 30 and the rim of the cup 40. This gap can be of some 5 to 10 millimeters, but if desired the gap can be removed completely by the edge of the skirt 33 of the distributor 30 extending for a length which brings it into contact with the hob 141 surface.

Illustrated in FIGS. 10 to 15 is an a cooking gas burner 100 similar to the burner 10 that is described above in relation to FIGS. 1 to 9, and like parts have been like numbered. One difference between the burners 10 and 100, is that the burner 100 has its cup 40 integrally formed into the hob surface 140 of a cooking appliance. This will mean that a screw will pass through the hob 140 and engage or be secured to the post 72.

Another difference between the burner 10 and 100 is that the burner 100 has the shorter post 74 utilised to support the distributor 30 thereon. This is done by using a concentrically located spacer 200 which has a portion protruding through an aperture 143 in the hob 140. The top of the spacer 200 has a similarly shaped aperture to the aperture 46 in the burner 100, so as to receive the spigot 32 of the distributor 30.

The spacers 200 can be of any appropriate material including metals, polymers or insulative material.

By means of the manifold 50, with posts 72 and 74, a single manifold can be utilised for either the burner 10 or 100, thus decreasing inventory of the distributor 50, whilst at the same time providing a simple and efficient means to assemble the distributor 50 onto the cup/hob, making re-assembly after cleaning an uncomplicated task.

By means of the height of the posts 72, the manifold 50 can be kept, at a distance from the cup 40, of between 5 and 20 millimeters, except at the location where contact may be made between the injector post 70 and the aperture 44. The injector post 70 is designed to have a clearance of 0.1 mm approximately from the inside rim of the aperture 44, so theoretically no contact is actually made between the injector 70 and the aperture 44 however, manufacturing tolerances will probably result in some contact being made.

Figure 18:
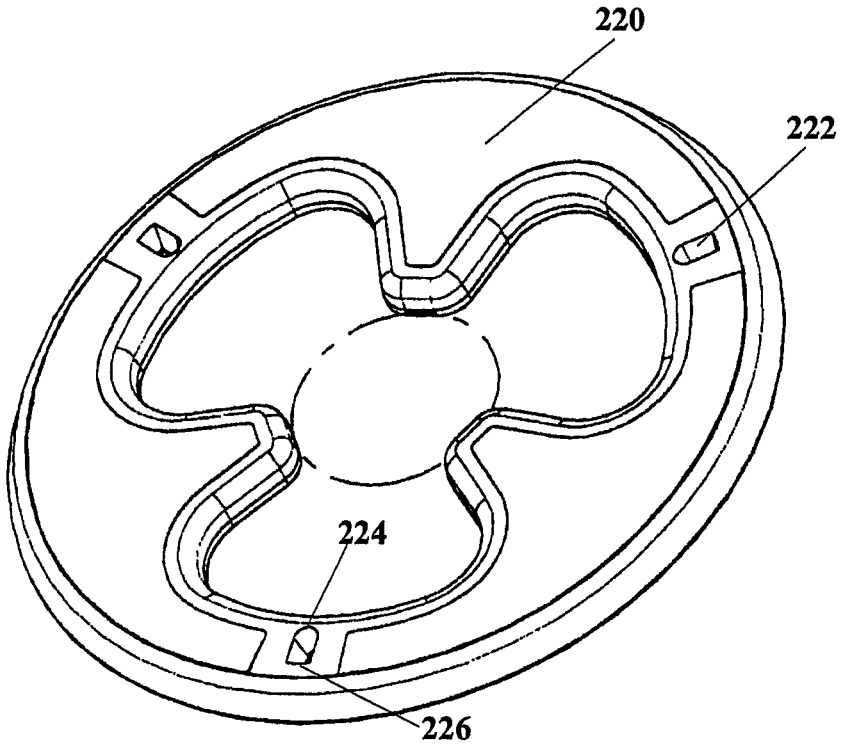
FIG. 18 illustrates a perspective view of an alternative cap for a gas burner assembly.
Figure 19:
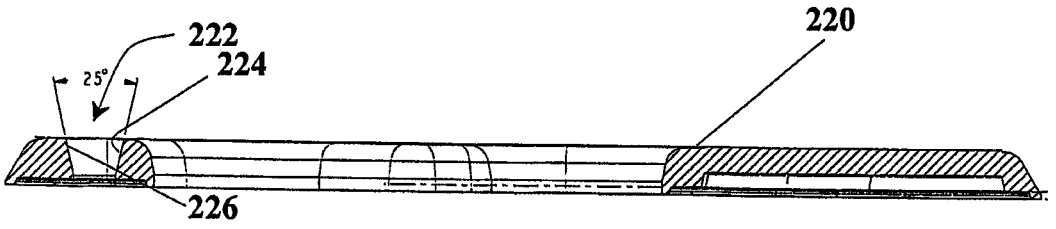
FIG. 19 illustrates a cross section through the cap of FIG. 18.
Figure 23:
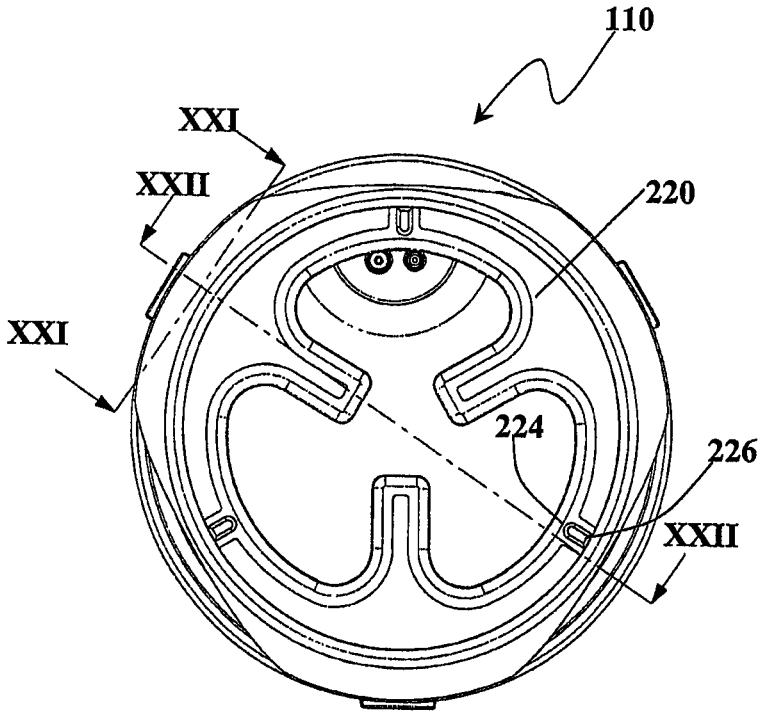
FIG. 23 illustrates a plan view of an assembled gas burner with a cap similar to that of FIGS. 18 and 19.

Illustrated in FIGS. 18, 19 and 23 is a cap 220 which is similar in shape and features to the cap 20 of previous figures. However the cap 220 differs from the cap 20 in that at three equi-spaced locations are cross lighting air apertures 222, which are arranged to be positioned over the cross lighting gaps 37, when the cap 220 and distributor 30 are properly assembled.

As illustrated in FIG. 19, the apertures 222 are tapered in cross section, whereby the aperture has a larger cross sectional area at the top of the cap 220 by comparison to the outlet of the aperture at the underneath surface of the cap 220. Further, as illustrated in FIGS. 18 and 23 the shape of the apertures can be described as a "D" shape in plan view where the inner wall 224 relative to the centre of the burner assembly is curved, while the radially outer wall 226 is relatively straight sided.

Illustrated in FIG. 20 is a modified cup 240, which is similar to the cup 40 of previous figures. The cup 240 in FIG. 20 illustrates in plan view a downwardly extending concave formation 46, which will receive a spigot 32 downwardly extending from a distributor 30.

As can be seen in FIGS. 20, 21 and 23, the base 246 of the formation 46 is elliptical and generally horizontal with the wall 248 of the formation 46 also being elliptical and tapered. It will be noted that the major axes of the ellipses from which the formation 46 is formed lay generally on or parallel to a radial axis from the centre of the burner assembly 110 of FIG. 23.

The spigot 32, as illustrated in FIGS. 21 and 22 can be considered as being of a truncated conical formation, with the truncated end surface 47 being of the order of 2.5 $mm^2$ in area. The surface area of the truncated end of spigot 32 is kept to a minimum. If desired, the spigot 32 can terminate in a small radiused apex, producing a part spheroidal end, in effect providing an even smaller area of contact or a point contact, thereby further minimising heat transferal. This surface will make contact with the base 246 of formation 46.

From FIG. 21 it will be noted that the formation 46 has a shallower taper than is found on the taper on the conically formed spigot 32. This difference in taper ensures that if any contact were made, at the most a point or line contact would be made between the two surfaces.

When burner 110 is cold, the spigot 32 preferably has clearances X and Y as illustrated in FIG. 22, relative to the walls 248 of the formation 46. Preferably the Clearance Y is of the order of 0.5 mm to 1 mm, while the clearance X is of the order of 1.5 mm to 3 mm and most preferably of the order of 2 mm. However as the distributor 30 heats up during use, the distributor will, due to thermal expansion, increase its overall dimensions. To accommodate this thermal expansion, the relative location of the spigots 32 will change by sliding radially outwardly over the elliptical surface of the base 246. This movement will not change the amount of the contact area between the cup 240 and distributor 30

When cold the spacing, between the radially outward extremities of the spigot 32 and formation 46, is approximately 2 mm. After thermal expansion an air gap will preferably remain. However if it does not, a line of contact between these radially outward extremities could form. Such lines of contact will help to keep to a minimum the contact surface areas between the distributor 30 and cup 240.

As will be readily understood, and as indicated above the features relating to cup 240 can be formed in a separate cup or into a hob surface.

By reducing the contact surface area between the cup 40 or 240 and the manifold 50 transfer of heat by conductive means is decreased. This is further assisted by the hob 141 and 140 acting as a heat sink to draw heat away from the cup 40 or 240. Further as the manifold 50 is below the cup 40 or 240 a minimum of heat will be transferred to the manifold 50 from the cup 40 or 240 by means of convection and as the cup 40 or 240 is located between the distributor 30 and the manifold 50, radiated heat from flame at the flame ports 31 will also not pass directly through to the manifold 50, except by the radiation emitted from the bottom of the cup 40 or 240. By these means the gas passing through the gas manifold 50 will be less detrimentally affected by heat than prior art burners, thus assisting to maintain the calorific value of the fuel passing into the injectors (by keeping the gas supply as dense as possible), and thus assisting the efficiency of the burner 10 and 100.

It will be understood that the invention disclosed and defined herein extends to all alternative combinations of two or more of the individual features mentioned or evident from the text. All of these different combinations constitute various alternative aspects of the invention.

The foregoing describes embodiments of the present invention and modifications, obvious to those skilled in the art can be made thereto, without departing from the scope of the present invention.

The invention claimed is:

1. A cooking gas burner assembly including a distributor (30), a gas manifold (50) and a cup (40), said gas manifold (50) including at least one gas inlet and a plurality of gas outlets to deliver supply gas to said distributor (30), said cup (40) being in contact with a hob (141) of a cooking appliance and located between said gas manifold (50) and said distributor (30), wherein said gas manifold (50) is spaced from said cup (40) by at least one post (70,72,74) extending vertically between said manifold (50) and said cup (40), and wherein the cup (40) forms a shield between the manifold (50) and the distributor (30) that reduces conductive heat transfer from the distributor (30) to the manifold (50);

wherein said distributor (30) includes downwardly extending spigots (32) to engage said cup (40), each spigot (32) defined by a truncated conical geometry with a sidewall and an end surface;

wherein said cup (40) includes a plurality of discrete, enclosed concave recesses (48) that each receive one of said spigots (32), wherein the enclosed recesses (48) are elliptical in cross section and each enclosed recess (48) having two surfaces is defined by an interior sidewall surface and a base surface that supports the end surface of the spigot (32);

wherein the sidewall of the spigot (32) is provided at a first angle relative to the base surface and the sidewall surface of the enclosed recess (48) is provided at a second angle relative to the base surface that is different from the first angle so that as said distributor (30) changes dimensions during use due to thermal expansion, limiting contact between the sidewall of the spigot (32) and the sidewall surface of the enclosed recess (48) due to the difference between the first and second angles; and wherein said enclosed recess (48) has an elongated shape.

2. A cooking gas burner as claimed in claim 1, wherein said distributor (30) includes a primary air and gas supply mixing means (35).

3. A cooking gas burner as claimed in claim 2, wherein said distributor (30) includes apertures (34) therein to allow primary air to be drawn into said mixing means (35).

4. A cooking gas burner as claimed in claim 2, wherein said cup (40) forms the underside of a passage which allows primary air to be drawn into said mixing means (35).

5. A cooking gas burner as claimed in claim 1, wherein said gas manifold (50) and said cup (40) are spaced from each other by a plurality of posts (70,72,74) extending vertically between said manifold (50) and said cup (40).

6. A cooking gas burner as claimed in claim 5, wherein said distributor (30) includes a primary air and gas supply mixing means (35) and at least one of said posts (70) includes a wall of at least one upwardly directed passage (71) from said manifold (50) by which said manifold (50) delivers supply gas to said mixing means (35).

7. A cooking gas burner as claimed in claim 1, wherein the minimum spacing between said manifold (50) and said cup (40) is approximately 5 millimeters.

8. A cooking gas burner as claimed in claim 1 wherein said distributor (30) has a contact area (47) with said cup (40) of between 5 to 20 square millimeters.

9. A cooking gas burner as claimed in claim 1, wherein said distributor (30) includes a skirt therearound, said skirt (33) including apertures (34), whereby a bottom edge of said apertures (34) is provided by said cup (40).

10. A cooking gas burner as claimed in claim 9, wherein the lower most rim of said skirt (33) is spaced from said cup (40) by between 5 and 15 millimeters.

11. A cooking gas burner as claimed in claim 1 wherein said manifold (50) has a two piece construction.

12. A cooking gas burner as claimed in claim 11, wherein said gas manifold (50) has a body portion (52) having a generally planar construction.

13. A cooking gas burner as claimed in claim 1, wherein at locations of contact between said distributor (30) and said cup (40), and or between said cup (40) and said manifold (50), there are provided heat insulating members (200).

14. A cooking gas burner as claimed in claim 1 wherein said cup (40) provides a means to secure said cooking gas burner to said hob (141) of a cooking appliance.

15. A cooking gas burner as claimed in claim 1, wherein said cup (40) is integrally formed in said hob (140) of a cooking appliance.

16. A cooking gas burner as claimed in claim 1, wherein said spigots (32) terminate in one of: a point; a flat surface; a part spheroidal surface.

17. A cooking gas burner as claimed in claim 1 wherein the elongated shape has a major axis which substantially lies on or is substantially parallel to a virtual radius emanating from a centre of said burner.

18. A cooking gas burner as claimed in claim 1 wherein said enclosed recesses (48) have an elongated, generally horizontal base (246), said base (246) being of the same general shape as said enclosed recess (48).

19. A cooking gas burner as claimed in claim 1 wherein said enclosed recesses (48) and said spigots (32) each have a tapered construction.

20. A cooking gas burner as claimed in claim 19, wherein said enclosed recesses (48) have a shallower taper than said spigots (32).

21. A cooking gas burner as claimed in claim 1 wherein said spigots (32) are able to slide over a surface of said cup (40).

* * * * *